US009260773B2

(12) United States Patent
Lee et al.

(10) Patent No.: US 9,260,773 B2
(45) Date of Patent: Feb. 16, 2016

(54) NANOCRYSTAL TITANIUM ALLOY AND PRODUCTION METHOD FOR SAME

(75) Inventors: Sang-Hak Lee, Yokohama (JP); Yoshiki Ono, Yokohama (JP); Kazuya Ikai, Yokohama (JP); Hiroaki Matsumoto, Sendai (JP); Akihiko Chiba, Sendai (JP)

(73) Assignees: NHK SPRING CO., LTD., Yokohama-shi (JP); TOHOKU UNIVERSITY, Sendai-shi (JP)

( * ) Notice: Subject to any disclaimer, the term of this patent is extended or adjusted under 35 U.S.C. 154(b) by 0 days.

(21) Appl. No.: 13/496,750

(22) PCT Filed: Sep. 22, 2010

(86) PCT No.: PCT/JP2010/066379
§ 371 (c)(1), (2), (4) Date: Mar. 16, 2012

(87) PCT Pub. No.: WO2011/037127
PCT Pub. Date: Mar. 31, 2011

(65) Prior Publication Data

US 2012/0168042 A1 Jul. 5, 2012

(30) Foreign Application Priority Data

Sep. 25, 2009 (JP) ..... 2009-221214

(51) Int. Cl.

| | |
|---|---|
| ***C22C 14/00*** | (2006.01) |
| ***C22F 1/18*** | (2006.01) |
| ***C22F 1/00*** | (2006.01) |
| ***C22C 1/02*** | (2006.01) |
| *C22C 16/00* | (2006.01) |

(52) U.S. Cl.
CPC . *C22F 1/183* (2013.01); *C22C 1/02* (2013.01); *C22C 14/00* (2013.01); *C22F 1/00* (2013.01)

(58) Field of Classification Search
USPC ..... 148/421, 557
See application file for complete search history.

(56) References Cited

U.S. PATENT DOCUMENTS

2006/0127266 A1 6/2006 Miura et al.
2006/0213592 A1* 9/2006 Ko et al. ..... 148/670

FOREIGN PATENT DOCUMENTS

JP A-06-272004 9/1994
JP A-10-306335 11/1998

(Continued)

OTHER PUBLICATIONS

International Search Report issued in Application No. PCT/JP2010/066379; Dated Mar. 8, 2011.

(Continued)

*Primary Examiner* — Kaj K Olsen
*Assistant Examiner* — Alexander Polyansky
(74) *Attorney, Agent, or Firm* — Oliff PLC

(57) ABSTRACT

A titanium alloy has high strength and superior workability and is preferably used for various structural materials for automobiles, etc. The titanium alloy is obtained by the following production method. An alloy having a structure of α' martensite phase is hot worked at conditions at which dynamic recrystallization occurs. The working is performed at a heating rate of 50 to 800° C./second at a strain rate of 0.01 to 10/second when the temperature is 700 to 800° C. or at a strain rate of 0.1 to 10/second when the temperature is more than 800° C. and less than 1000° C. so as to provide a strain of not less than 0.5. Thus, equiaxed crystals with an average grain size of less than 1000 nm are obtained.

9 Claims, 9 Drawing Sheets

(56) References Cited

FOREIGN PATENT DOCUMENTS

| | | | | |
|---|---|---|---|---|
| JP | A-2002-527611 | | 8/2002 | |
| JP | 2003342704 | A * | 12/2003 | ..... C22F 1/18 |
| JP | A-2004-107691 | | 4/2004 | |
| JP | A-2004-143596 | | 5/2004 | |
| JP | B2-3789852 | | 6/2006 | |

OTHER PUBLICATIONS

Zherebtsov et al., "Production of Submicrocrystalline Structure in Large-Scale Ti—6Al—4V billet by Warm Severe Deformation Processing," Scripta Materialia, vol. 51, pp. 1147-1151, 2004.
Nakahigashi et al., "Ultra-Fine Grain Refinement and Tensile Properties of Titanium Alloys Obtained Through Protium Treatment," Journal of Alloys and Compounds, vol. 330-332, pp. 384-388, 2002.
Salishchev et al., "Development of Ti—6Al—4V Sheet with Low Temperature Superplastic Properties," Journal of Materials Processing Technology, vol. 116, pp. 265-268, 2001.
Murzinova et al., "Formation of Nanocrystalline Structure in Two-Phase Titanium Alloy by Combination of Thermohydrogen Processing with Hot Working," International Journal of Hydrogen Energy, vol. 27, pp. 775-782, 2002.
Nag et al., "ω-Assisted Nucleation and Growth of α Precipitates in the Ti—5Al—5Mo—5V—3Cr—0.5Fe β Titanium Alloy," Acta Materials, vol. 57, pp. 2136-2147, 2009.
Mironov et al., "Microstructure Evolution During Warm Working of Ti—6Al—4V with a Colony-α Microstructure," Acta Materialia, vol. 57, pp. 2470-2481, 2009.
Jun. 4, 2014 Supplementary European Search Report issued in European Application No. 10818800.4.
Sep. 15, 2009 Structural formation of Ti—6Al—4V alloy, of which a processing starting structure is an alpha' martensite, after hot compression deformation.
Mar. 28, 2009 Hot workability characteristics and processing map of Ti—6Al—4V alloy of which a processing starting structure is an alpha' martensite.

* cited by examiner

Color Coded Map Type:Grain Orientation Spread

Color Coded Map Type:Grain Orientation Spread

| Min | Max |
|---|---|
| 0 | 3 |

NANOCRYSTAL TITANIUM ALLOY AND PRODUCTION METHOD FOR SAME

TECHNICAL FIELD

The present invention relates to a high-strength titanium alloy and to a production method therefor. In particular, the present invention relates to a hot-worked titanium alloy containing nanocrystals and having high strength and superior workability, and also relates to a production method therefor.

BACKGROUND ART

In general, titanium alloys are used for automobile parts, and in particular, β titanium alloys are commonly used for suspension springs in which high strength is required, valve springs of engines, and suspension springs for motorcycles. The titanium alloys that are generally classified as β type have superior cold workability and are relatively easily provided with high strength by heat treatment. The β titanium alloys are usually made by solution treating a β phase material, which is stable at high temperatures, so as to have a metastabilized β phase at room temperature. Therefore, β phase stabilizing elements such as V and Mo, which are expensive, and Cr, must be added to the β titanium alloys in large amounts. Accordingly, demands for titanium alloy parts made of inexpensive materials with strengths comparable to that of the β titanium alloys have been increasing.

In the β titanium alloys, the strength can be increased by a heat treatment such as an α phase precipitation hardening treatment. However, for mechanical parts, fatigue strength is important in view of practical use. The β titanium alloys break by cracks that are generated within the precipitated α phase grain or that are generated at a boundary between the α phase and the β phase. These cracks are thought to occur due to difference in elastic strain between the α phase and the β phase. Therefore, in a structure such as in the β titanium alloys that are strengthened by precipitating the α phase from the β matrix phase in an aging treatment, static strength is superior, but improvement of the fatigue strength is limited. On the other hand, titanium alloys of a near α type and an α+β type contain small amounts of the expensive β phase stabilizing elements and small amount of the β phase that is easy to deform and has low strength. Therefore, for the above reasons, these titanium alloys are anticipated to be usable in automobile parts in view of production costs and strengths.

As disclosed in, for example, Japanese Patent No. 3789852, a Ti-6Al-4V (mass %) alloy, which is typical as the α+β type, has a good balance of mechanical characteristics such as strength, ductility, and toughness. Therefore, the amount of production of this alloy accounts for approximately 70% of the total amount of production of titanium alloys, and the penetration rate of this alloy is high. Accordingly, the Ti-6Al-4V alloy is inexpensive and has small variations in the compositions and the material strength.

The mechanical characteristics of the Ti-6Al-4V alloy mainly depend on a structure shape. That is, the characteristics and the strength depend on whether the structure is an equiaxed structure, an acicular structure, or a bimodal structure. In general, the equiaxed structure is superior in strength, elongation, resistance to fatigue crack initiation, and plastic workability. The acicular structure is superior in creep resistance, fracture toughness, and crack growth resistance. The bimodal structure has the advantages of both the equiaxed structure and the acicular structure.

The conventional structural control of the Ti-6Al-4V alloy by working is mainly performed by hot working in a temperature range in which the β phase or the α+β phase is stable. In this case, a starting structure before the hot working is a structure of equiaxed α+β phase or of acicular α+β phase. The present inventors had an idea that refining of the crystal grains may be effective for obtaining a material which has superior workability for part shapes and has high strength. Then, the present inventors experimented with various thermomethanical treatments on a structure of the equiaxed α+β phase or of the acicular α+β phase as a starting structure. As a result, however, the grain sizes of the α crystals were on the order of micrometers even at the smallest, or the structures were mixed with coarsened grains and were not uniform. Moreover, the structures could be structures other than the equiaxed structure. Accordingly, superior workability for part shapes and good mechanical characteristics were not anticipated for the structures.

Disclosure of the Invention

An object of the present invention is to provide a titanium alloy, which is suitably used for structural members such as automobile parts, instead of β titanium alloys, and a production method therefor. This titanium alloy is formed by further improving workability, strength, and toughness of a titanium alloy that has a general standard composition of Ti-6Al-4V type, which is inexpensive and widely used, or that has a structure of the near α type or the α+β type. The β titanium alloy has a composition of a titanium alloy that can be age hardened after it is formed so as to have metastable β phase at room temperature.

The present inventors investigated a titanium alloy having a composition of inexpensive titanium alloys that are classified as the near α type or the α+β type, instead of the β titanium alloy composition. The titanium alloys of the near α type or the α+β type do not contain a single β phase but contain the α phase at high rate at room temperature when formed by normal cooling after a solution treatment. The α phase is difficult to be formed into a part shape and generally has a structure of crystal grains in the order of micrometers. Then, the present inventors found a titanium alloy having superior workability for parts and high toughness by forming the α phase so as to have a fine equiaxed structure on the order of nanometers. Moreover, the titanium alloy has high strength and high fatigue strength by decreasing the β phase as little as possible. Furthermore, the present inventors have achieved forming a uniform nanocrystal grain structure in a titanium alloy having a starting structure of α' martensite which was not much used before. Thus, the present invention has been completed.

Titanium alloys have high notch sensitivity and have a high crack growth rate compared with steels once a crack is generated. For this reason, the present inventors considered forming a structure primarily made of equiaxed crystals to improve the resistance to initial crack generation, in addition to improving the strength by refining crystal grains. That is, the present inventors considered generating uniform fine equiaxed crystals by working for improving the strength and toughness, thereby improving fatigue strength. In particular, the present inventors have concluded that resistance against working is decreased and the workability for part shapes is improved by forming a fine equiaxed structure with very low dislocation density. In this case, the fine equiaxed structure is formed by occurring dynamic recrystallization in hot working and by generating not less than 80% of the equiaxed crystals in an area which is deformed at not less than 0.5 of strain.

When titanium alloys are hardened after a solution treatment, α' martensite crystals are generated. These crystals are a crystal phase that is formed by diffusionless transformation in a solution heat treatment and is not generated in the β titanium alloys because the β phase remains even at room temperature. The α' martensite crystals are acicular and have a hexagonal close-packed structure as in the case of equilibrium α crystals. The difference between the α' martensite crystals and the equilibrium α crystals is that the former becomes a thermally unstable crystal phase by rapid cooling and includes numerous defects in the acicular structure. The defects are α' (10-11) twins, stacking faults on α' (0001) crystals, dislocations, and the like. In this case, "−1" represents 1 with a bar (−) on its top. This is the same as in the descriptions in the section [0018]. Such stacking faults and accumulating areas of the dislocations are energetically unstable and easily function as recrystallization nucleation sites. Therefore, the α' martensite phase contains numerous areas that function as nucleation sites compared with the α+β phase. Accordingly, the present inventors expected that uniform fine equiaxed crystals on the order of nanometers are easily generated in a large area by hot working the α' martensite structure as a starting structure.

That is, the present invention provides a production method for titanium alloy, which includes preparing a titanium alloy and rapidly cooling the titanium alloy from a β transus temperature so as to generate an α' martensite phase. The production method also includes hot working the titanium alloy primarily made of the α' martensite phase as a starting structure so as to result in dynamic recrystallization.

Specifically, in order to cause the dynamic recrystallization, the working is performed by heating the titanium alloy at a heating rate of 50 to 800° C./second and providing strain of not less than 0.5 at a strain fate of 0.01 to 10/second in a temperature range of 700 to 800° C. Alternatively, in a temperature range of more than 800° C. and less than 1000° C., the working is performed so as to provide a strain of not less than 0.5 at a strain rate of 0.1 to 10/second. As the method of the hot working, a working method by which the dynamic recrystallization occurs while the working, such as press working or extruding, is used. After the hot working, the titanium alloy is cooled at a rate of not less than 20° C./second so as not to coarsen nanosize crystal grains that are generated by the dynamic recrystallization.

The titanium alloy produced as described above has a composition that is generally classified as a titanium alloy of at least one of the near α type and the α+β type. The titanium alloy contains a structure in which equiaxed crystals with an average grain size of less than 1000 nm are uniformly dispersed. In an observation at accelerating voltage of 20 kV at 50000-times magnification by a SEM/EBSD method, the smallest grain size that can be resolved is 98 nm. Therefore, the smallest grain size in the present invention is substantially 98 nm. In general, α+β titanium alloys contain 10 to 50% of the β phase by area ratio at room temperature when formed by cooling at a rate of an ordinary casting and the like. In addition, near α titanium alloys contain 1 to 2 mass % of the β phase stabilizing elements such as V, Cr, and Mo, and contain more than 0% and less than 10% of the β phase by area ratio at room temperature when formed by cooling at the above rate. In the present invention, one of the α+β titanium alloys and the near α titanium alloys is rapidly cooled so as to have an α' martensite structure in almost all areas (at a level in which the β phase cannot be detected by X-ray diffraction method), whereby a starting material is obtained. Then, by hot working the starting material, the titanium alloy of the present invention is obtained. In the titanium alloy of the present invention, the area ratio of the β phase is preferably not more than 1.0%. If the area ratio of the β phase is more than 1.0%, probability of the occurrence of fractures at interfaces between the α phase and the β phase is increased, whereby the fatigue strength is decreased. Materials containing more than 50% of the β phase by area ratio at room temperature which do not result in martensite transformation are called "β titanium alloys".

The above equiaxed crystals of the present invention include few dislocations within the crystals and form a fine uniform structure, which can be known from a GUS map by the EBSD method. Therefore, the equiaxed crystals are expected to have improved strength and workability for part shapes compared with conventional titanium alloys.

According to the invention disclosed in Japanese Patent No. 3789852, α' martensite is used for strengthening a Ti-6Al-4V alloy of the α+β type. In the invention disclosed in Japanese Patent No. 3789852, acicular α crystals are precipitated in the α' martensite structure by heat treatment, whereby strength and toughness are improved. In this case, yield strength, hardness, and toughness are simultaneously improved. However, in the invention disclosed in Japanese Patent No. 3789852, an ordinary structure containing large crystal grains is formed, in which hardness and toughness have an inverse relationship. Therefore, the hardness and the toughness cannot be improved simultaneously. In this case, the toughness was estimated from a rate of reduction in area at a fracture surface of a test piece after a tensile test, but there are no comparative examples, and the toughness is difficult to evaluate accurately.

On the other hand, in the present invention, workability, strength, and toughness of a titanium alloy are greatly improved. In the high strength titanium alloy and the production method therefor of the present invention, the structure and the production method are specified as described above for the following reasons.

In order to form the α' martensite structure as the starting structure in the production method of the present invention, a titanium alloy composition that is usually classified as the near α titanium alloy or the α+β titanium alloy is suitable. For example, a titanium alloy with a composition that is usually classified as an α titanium alloy may be rapidly cooled from a β transus temperature in order to form the α' martensite in the entirety of the titanium alloy. In this case, the β transus temperature is shifted to a higher temperature range, and energy required for heating this titanium alloy is increased, which is inefficient. Moreover, when this titanium alloy is in a certain temperature range, a brittle $\alpha_2$ phase (for example, $Ti_3Al$) is generated. Therefore, not almost the entirety of this alloy is formed with the α' martensite structure. On the other hand, in a near β titanium alloy and a β titanium alloy, the β phase is metastably maintained at room temperature. Therefore, a structure in which almost the entirety is formed with the α' martensite phase cannot be obtained even by rapid cooling each of these titanium alloys. In this case, the β phase is detected by X-ray diffraction or the EBSD analysis, and the β phase remains. Accordingly, a uniform and fine dynamic recrystallized structure is not obtained by using the α' martensite. In contrast, in a composition that is usually classified as the near α titanium alloy or the α+β titanium alloy, the β phase is hardly detected at the same analysis accuracy after the same treatment as in the cases describe above. Accordingly, the compositions that are classified into one of the near α titanium alloy and the α+β titanium alloy are preferably used.

The α' martensite is used as a starting structure because it is thermally unstable and contains numerous defects in the acicular structure, and the sites of the defects easily function as recrystallization nucleation sites. Moreover, whereas dislocations of α<11-20> in "a" axis direction mainly shift in an acicular α+β mixed structure, dislocations in "c" axis direction also actively shift in addition to the dislocations in "a" axis direction, in the α' martensite. Therefore, the α' martensite has a higher deformability compared with an α structure and has dislocation intersection spots in greater number in multiple directions in the acicular structure compared with the α+β mixed structure. The intersection spots function as nucleation sites. Thus, the α' martensite phase can have substantial nucleation sites by hot working compared with a case of using the α+β phase as a starting structure. Accordingly, using the α' martensite phase as the starting structure in the hot working is effective.

Reasons for limiting the above numerical values will be described hereinafter. The numerical values were investigated based on the following conditions in order that energy (heat, time) provided to a starting structure does not cause grain coarsening and transformation to an equilibrium phase of α+β phase. That is, the starting structure is rapidly heated so as to prevent precipitation of a coarsened equilibrium phase, and is worked for generating numerous recrystallization nucleation sites.

Heating rate: 50 to 800° C./second

The α' martensite phase as a starting structure is thermally unstable. Therefore, if a heating rate is less than 50° C./second, the starting structure is transformed into the equilibrium phase of the α+β phase. On the other hand, if the heating rate is greater than 800° C./second, although it depends on dimensions of a material, the temperature is difficult to control by a practical heating means in a series of processes. In addition, a temperature difference between the surface and the inside of the material becomes too great, whereby an area formed with the structure of the present invention is not very widely obtained. Moreover, if the heating rate is greater than 800° C./second, a difference in flowability between the surface and the inside of the material becomes great, which undesirably cause cracks in the working. Accordingly, the heating rate of the titanium alloy is set to be 50 to 800° C./second.

Strain rate when a hot working temperature is 700 to 800° C.: 0.01 to 10/second

Strain rate when a hot working temperature is greater than 800° C. and less than 1000° C.: 0.1 to 10/second Strain: not less than 0.5

According to the above hot working conditions, the dynamic recrystallization actively occurs in the titanium alloy, and uniform fine equiaxed crystals with an average grain size of less than 1000 nm are formed when the α' martensite phase is used as a starting structure for the working. If the working temperature is less than 700° C., driving energy is decreased as the working temperature is lowered and becomes insufficient to result in the dynamic recrystallization. Therefore, dynamic recrystallized area is decreased and is not uniform at the worked portion of the material. As a result, the entirety of the structure becomes a mixed structure of coarsened α crystals, which are elongated by the working, and a nanocrystal structure, which is not uniformly dynamic recrystallized. Alternatively, there may be a case in which the dynamic recrystallization does not occur and the nanocrystal structure is not generated. On the other hand, if the working temperature is 1000° C. or higher, generation and a growth rate of the β phase are rapidly increased, whereby an equilibrium phase of the β phase is coarsened. Then, the coarsened β phase is transformed into a coarsened α phase and an acicular structure by cooling to room temperature.

If the strain rate is less than 0.01/second at a working temperature of 700 to 800° C., or if the strain rate is less than 0.1/second at a working temperature of more than 800° C. and less than 1000° C., the transformation to the α+β phase and the grain coarsening occur in the structure. Therefore, the advantages of the dynamic recrystallization are not obtained. In addition, in view of an actual processing, the productivity is decreased. On the other hand, a strain rate of greater than 10/second is not practical. This is because the deformation resistance is rapidly increased due to the high machining rate, whereby cracks tend to be generated in the material and a machining device is overloaded.

The area ratio of the equiaxed crystals with an average grain size of less than 1000 nm must be not less than 80% in the structure. If the area ratio is less than 80%, a necessary strength is not obtained, and toughness is not effectively improved. That is, the titanium alloy must be worked so that the dynamic recrystallization occurs at not less than 80% of the entirety thereof. Therefore, not less than 0.5 of strain must be provided by the working. The area ratio of the above equiaxed crystals is preferably not less than 90%, and therefore, not less than 0.8 of strain is desirable. Equiaxed crystals have less than 3° of an angle difference in crystal orientation, indicating that the dislocation density is small and the dynamic recrystallization effective for the workability for part shapes occurred. The angle difference in crystal orientation is measured in a GUS map obtained by the Electron BackScattered Diffraction (EBSD) method. Accordingly, the working is performed so that the area ratio of such equiaxed crystals will not less than 80%, preferably, not less than 90%. The above structure may not be formed over the entirety of the material. The above structure may be formed within only a predetermined area at the area ratio specified in the present invention by applying the working conditions of the present invention. The predetermined area depends on the way the product will be used, such as a surface side for receiving high movement stress.

The numerical value of 0.5 for the strain is selected from a deformation resistance curve in hot working, for example, at 700 to 900° C., for obtaining the above structure. According to the deformation resistance curve, the deformation resistance is at the maximum value by initial strain and is reduced until the strain becomes less than 0.5 (work softening phenomenon). Then, the dynamic recrystallization is almost completed at a strain of not less than 0.5, whereby the structure comes to exhibit an approximately stable deformation resistance.

The strain in the present invention is expressed by the following First Formula.

$$e = \int_{l_0}^{l} \frac{d1'}{1'} = \ln\frac{l}{l_0}$$

Cooling rate after hot working: not less than 20° C./second

After the hot working, the material must be cooled at a cooling rate of not less than 20° C./second so as to not coarsen the nanocrystal grains that are generated by the dynamic recrystallization.

The titanium alloy of the present invention preferably consists of 4 to 9 mass % of Al, 2 to 10 mass % of V, and the balance of Ti and inevitable impurities. The average grain size is preferably not more than 600 nm. Moreover, the titanium alloy of the present invention preferably has a hardness of not less than 360 HV and 0.2% yield strength of not less than 1400 MPa.

Effects of the Present Invention

According to the present invention, in titanium alloys with a general standard composition of Ti-6Al-4V type, which are inexpensive and widely used, and titanium alloys with a structure of the near α type or the α+β type, workability, strength, and toughness are greatly improved. Therefore, titanium alloys that may be suitably used as a substitute for β titanium alloys for structural members such as automobile parts are provided.

EXAMPLES

Figure 1:
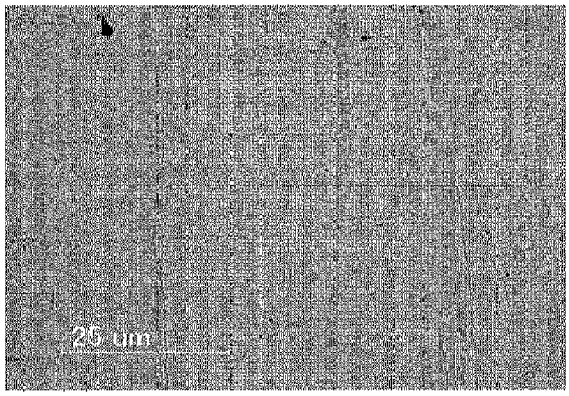
FIG. 1 shows a structure of a titanium alloy with a general composition of Ti-6Al-4V type, which is made of α' martensite phase and which is used as a starting material of a practical example of the present invention.

A titanium alloy with a general composition of Ti-6Al-4V type (grade 5), which is industrially widely used, was prepared. This titanium alloy was heated to 1050° C. for 1 hour in an electrical resistance furnace that had been preheated. Then, this titanium alloy was cooled with ice water, whereby a Ti-6Al-4V alloy made of α' martensite phase was prepared as a starting material. FIG. 1 shows an α' martensite structure. The sample had a height of 12 mm and a diameter of 8 mm and was axisymmetrically compressed by a Thermecmaster-Z (Fuji Electric Industrial Co., Ltd.) of a hot working simulator. The sample was maintained at a temperature in a range of 700 to 1000° C. for 5 minutes and was then worked at a strain rate in a range of 0.001 to 10/second so that the final strain amount came to 0.8. The heating rate before the working was 100° C./second until the temperature became (working temperature—100° C.) and then was 50° C./second. The cooling rate after the hot working was 25° C./second.

For comparison, a Ti-6Al-4V alloy, which had a starting structure of α+β mixed crystals and had not been subjected to a solution heat treatment, was prepared. This titanium alloy was also hot worked in the same condition as described above. After the hot working, in a cross section of a center of the worked portion, grain sizes, an area ratio of the β phase, and a dislocation density were evaluated. The evaluation was performed by an Electron BackScattered Diffraction (EBSD) apparatus (manufactured by TSL solutions Inc., OIM ver 4.6) mounted to an electron scanning microscope (JEOL Ltd., JSM-7000F). The grain sizes and each crystal orientation were measured by using an IPF (Inverse Pole Figure, a site with a difference in crystal orientation of not less than 5° is a grain boundary) map that can be analyzed based on an EBSD image. Similarly, the area ratio of the β phase was measured by using a phase map (difference of a crystal structure between the α phase and the β phase), and the dislocation density was measured by GOS (Grain Orientation Spread) map analysis. A crystal grain having less than 3° of an angle difference in crystal orientation between a certain EBSD focus and the adjacent point within the crystal grain is a crystal grain which contains dislocations at extremely small density and is generated by recrystallization. Therefore, an area ratio of such crystal grains was measured. As the mechanical characteristics, 0.2% yield strength was measured by a three-point bending test. Moreover, hardness at a center portion of the sample was measured.

Figure 4:
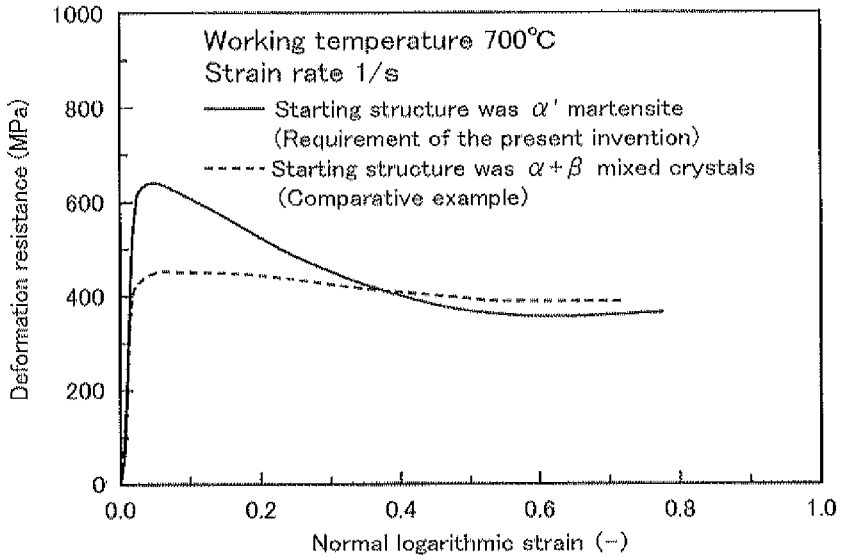
FIG. 4 shows a change in deformation resistance of a material having a starting structure of α' martensite or α+β mixed crystals during working at the working conditions of the present invention.

FIG. 4 shows a change in deformation resistance due to strain in working at a working temperature of 700° C. at a strain rate of 1/second. The working was performed to a material having a starting structure of α' martensite, which is the requirement of the present invention, and to a material having a starting structure of α+β mixed crystals of a comparative example. In the case of working the starting structure that satisfies the requirement of the present invention, the deformation resistance was peak at the strain of around 0.05 and then work softening phenomenon was observed. In this case, the deformation resistance was constant at a strain of not less than 0.5. This indicates that fine equiaxed crystals with small dislocation density were generated by the dynamic recrystallization as described above. On the other hand, in the case of the starting structure of the α+β mixed crystals of the comparative example, deformation resistance was not greatly changed. This indicates that the structure was not greatly changed during the working.

Figure 5:
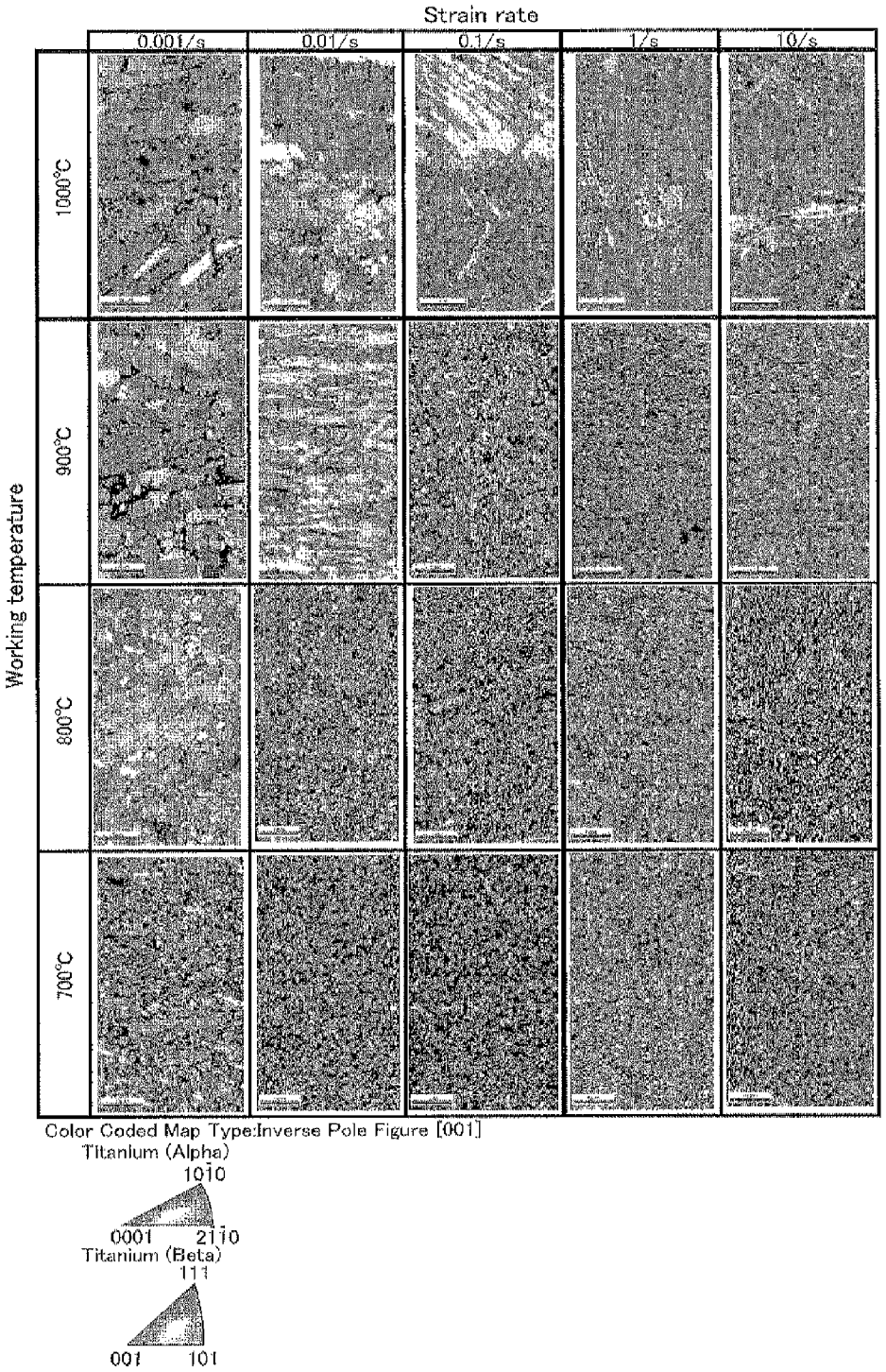
FIG. 5 shows IPF maps of backscattered electron diffraction patterns of materials which had a starting structure satisfying the conditions of the present invention and were worked at a working temperature of 700 to 1000° C. at a strain rate of 0.001 to 10/second. Some of the working conditions satisfy the conditions of the present invention, and the others do not.

FIG. 5 shows IPF maps of backscattered electron diffraction patterns of materials which had a starting structure satisfying the requirements of the present invention. The materials were worked at conditions which satisfied the requirements of the present invention or which did not. In this case, the materials were worked at a working temperature in the range of 700 to 1000° C. at a strain rate in the range of 0.001 to 10/second until the strain became around 0.8. When the working conditions satisfied the requirements of the present invention, uniform equiaxed nanocrystals were generated. Moreover, according to the result of crystal orientation analysis, the material of the present invention had a non-oriented structure and was thereby superior in workability for complicate part shapes. In contrast, when the working conditions did not satisfy the requirements of the present invention, coarsened α crystals and an acicular structure were generated.

Figure 6:
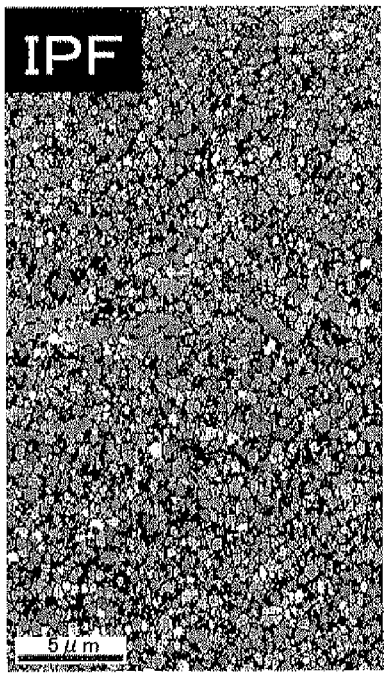
FIG. 6 shows an IPF map of a backscattered electron diffraction pattern of a material which had a starting structure of α' martensite that satisfies the condition of the present invention and which was worked at a working temperature of 800° C. at a strain rate of 10/second.
Figure 6:
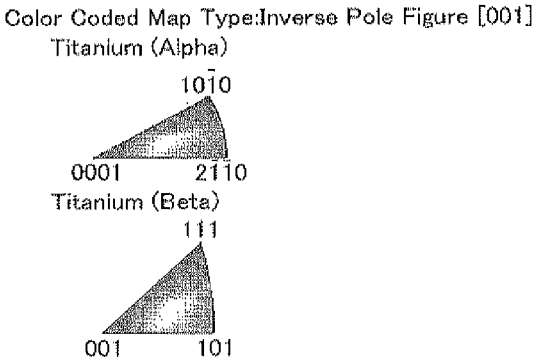
Figure 7:
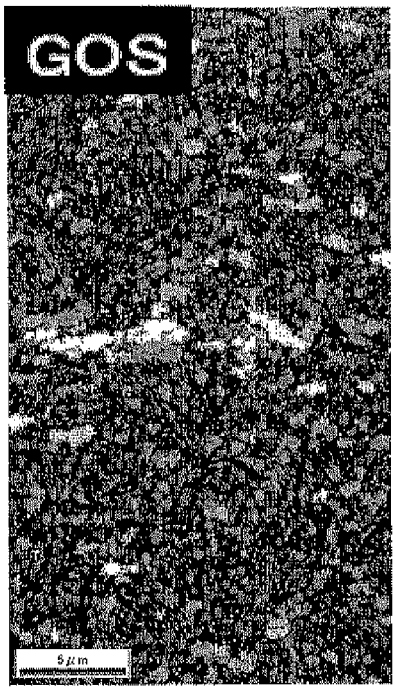
FIG. 7 shows a GOS map of a backscattered electron diffraction pattern of a material which had a starting structure of α' martensite that satisfies the condition of the present invention and which was worked at a working temperature of 800° C. at a strain rate of 10/second.
Figure 7:
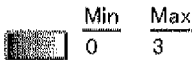

FIG. 6 shows an IPF map of a practical example of the present invention (working temperature 800° C., strain rate 10/second) obtained by the EBSD method, and FIG. 7 shows a GOS map thereof. The IPF map shows generation of uniform fine equiaxed nanocrystals with non-orientation. According to the GOS map, the area having less than 3° of the angle difference in crystal orientation was 94.3% in the observation visual field. This indicates that the crystals were nanocrystals which had a very small dislocation density and which were generated by the dynamic recrystallization.

Figure 8:
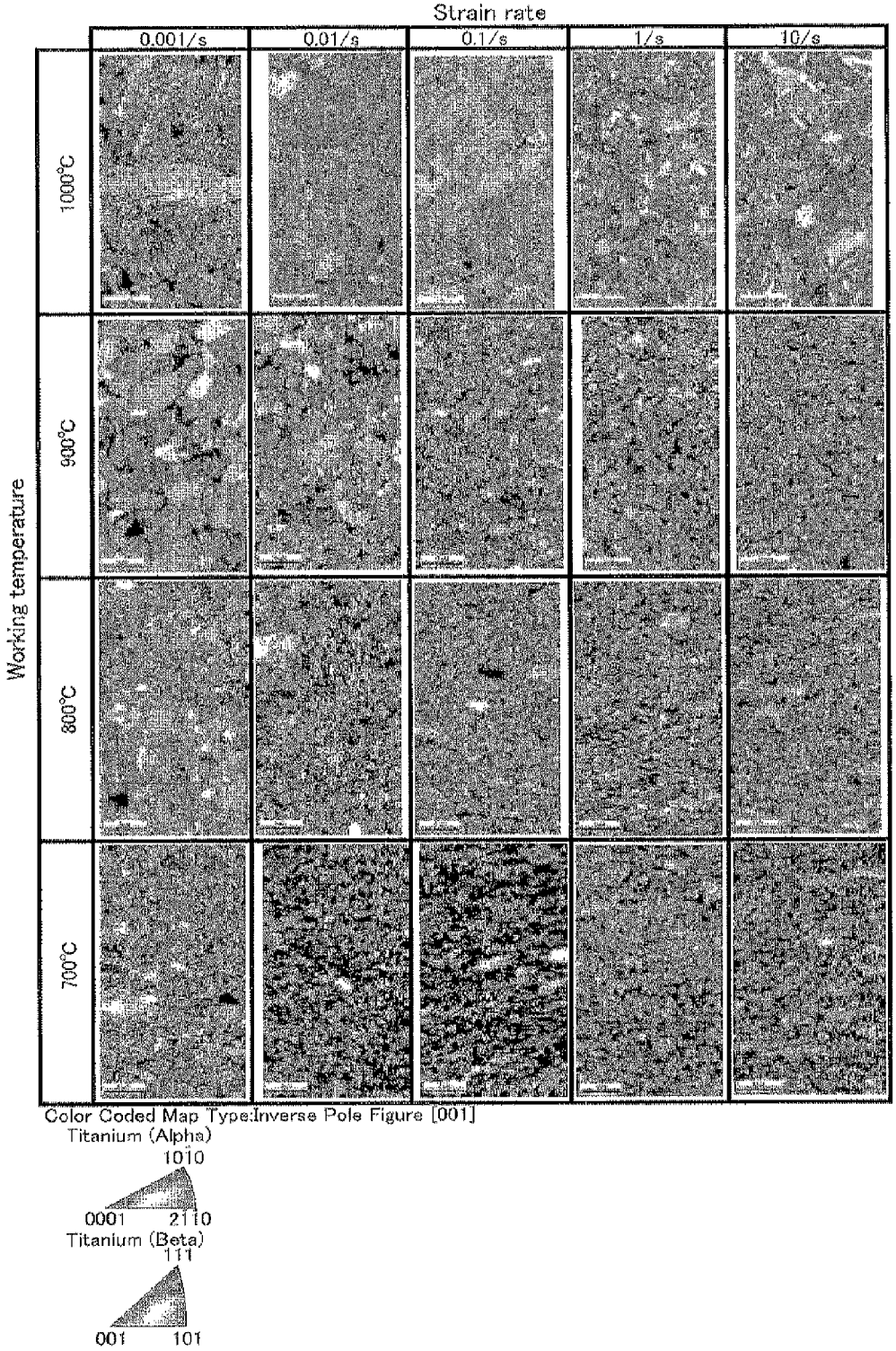
FIG. 8 shows IPF maps of backscattered electron diffraction patterns of materials which did not have a starting structure satisfying the condition of the present invention and were worked at a working temperature of 700 to 1000° C. at a strain rate of 0.001 to 10/second. Some of the working conditions satisfy the conditions of the present invention, and the others do not.

FIG. 8 shows IPF maps of materials, which were obtained by the EBSD method. The materials did not have a starting structure satisfying the requirements of the present invention, and were worked at conditions which satisfied the requirements of the present invention or which did not. That is, the materials were worked at a working temperature in a range of 700 to 1000° C. at a strain rate in the range of 0.001 to 10/second until the strain became around 0.8. In this case, a mixed structure of micron-size crystals and coarsened α crystals, or a coarsened acicular structure, was generated. Therefore, it was expected that the mechanical characteristics were not improved.

Figure 9:
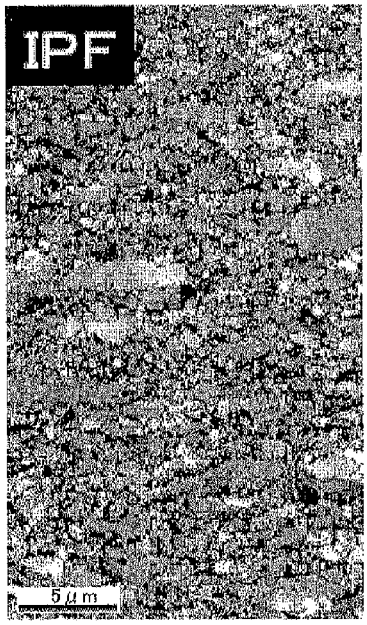
FIG. 9 shows an IPF map of a backscattered electron diffraction pattern of a titanium alloy with a general composition of Ti-6Al-4V type of a comparative example. This titanium alloy had a starting structure of α+β mixed crystals and was worked at a working temperature of 800° C. at a strain rate of 10/second.
Figure 9:
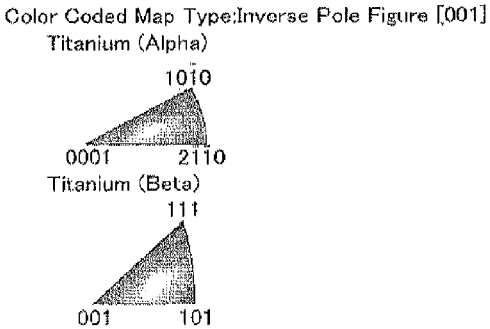
Figure 10:
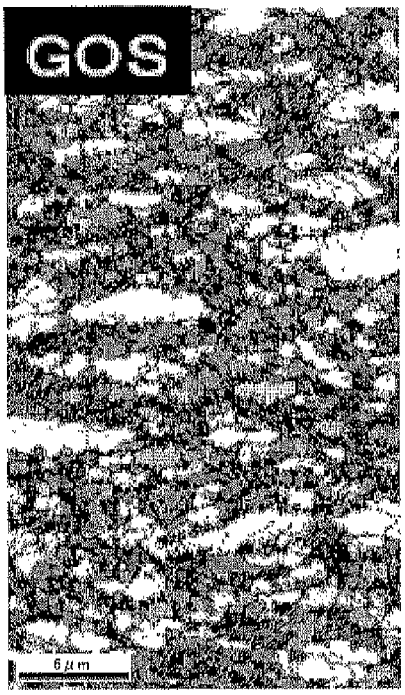
FIG. 10 shows a GOS map of a backscattered electron diffraction pattern of a titanium alloy with a general composition of Ti-6Al-4V type of a comparative example. This titanium alloy had a starting structure of α+β mixed crystals and was worked at a working temperature of 800° C. at a strain rate of 10/second.

For comparison, FIG. 9 shows an IPF map of the material worked at the conditions (800° C., strain rate 10/second) shown in FIG. 8, which was obtained by the EBSD method, and FIG. 10 shows a GUS map thereof. The IPF map shows that large amounts of coarsened α phase remained and dynamic recrystallized grains surrounded the coarsened α phase. According to the GUS map, the area having less than 3° of the angle difference in crystal orientation was only 61.1%. Therefore, the area having not less than 3° of the angle difference in crystal orientation was large, and the dislocation density in the entire structure was extremely high.

Figure 12:
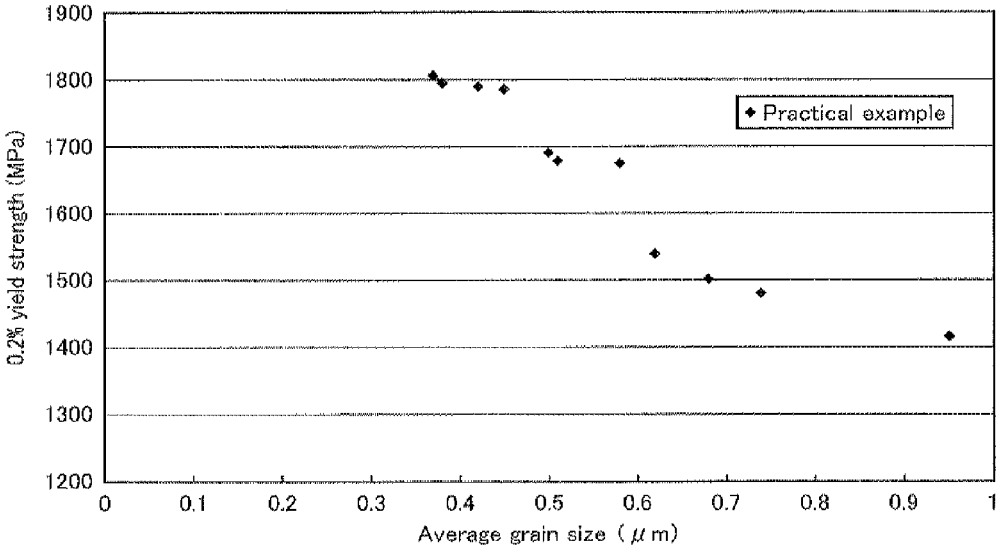
FIG. 12 is a graph showing a relationship between average grain size and 0.2% yield strength of materials of the present invention.

Results of analyzing the backscattered diffraction patterns and results of measuring the mechanical characteristics of the samples are shown in Table 1. The samples had a starting structure satisfying the requirements of the present invention and were worked at conditions which satisfied the requirements of the present invention or which did not. In addition, a relationship between the average grain size and the 0.2% yield strength in Table 1 is shown in FIG. 12. In the materials worked at a working temperature of 700 or 800° C. at a strain rate in the rage of 0.01 to 10/second, equiaxed nanocrystals were generated, and the area ratio of the β phase was not more than 0.8. Therefore, fracture at interfaces between the α phase and the β phase does not easily occur in these materials. Moreover, according to the results of analyzing the GUS map, these materials contained not less than 80% of the area, which has 0 to not more than 3° of the angle difference in crystal orientation, and had uniform fine equiaxed nanocrystals. Specifically, as shown in FIG. 12, the 0.2% yield strength was greatly improved when the average grain size was not more than 600 nm, and it was further improved when the average grain size was not more than 450 nm. In this case, the 0.2% yield strength was 1806 MPa and was the highest when the average grain size was 370 nm. Accordingly, the average grain size is preferably not more than 600 nm, more preferably not more than 450 nm, and further preferably not more than 370 nm. On the other hand, when the working temperature and the strain rate differed from the conditions of the present invention, although the material had a starting structure of the α' martensite, the structure was transformed to an acicular structure, or the crystal grains were coarsened. Accordingly, these materials did not have a necessary structure.

TABLE 1

Ti—6Al—4V alloy having a starting structure of α' martensite before working

| Temperature (° C.) | Strain rate (/sec) | Strain | Structure | Area ratio of crystal grains having an average grain size of less than 1000 nm (%) | Average grain size (μm) | Area ratio of β phase (%) | Area ratio of 0 to not more than 3° of angle difference in crystal orientation in GOS map (%) | 0.2% yield strength (MPa) | Hardness (HV0.1) | Notes |
|---|---|---|---|---|---|---|---|---|---|---|
| 700 | 0.001 | 0.78 | Coarsened α crystals and equiaxed nanocrystals | 55.5 | 1.25 | 0.6 | 71.4 | 1560 | 381.4 | |
| | 0.01 | 0.81 | Equiaxed nanocrystals | 99.6 | 0.42 | 0.6 | 91.8 | 1790 | 385.8 | Present invention |
| | 0.1 | 0.79 | Equiaxed nanocrystals | 98.4 | 0.37 | 0.7 | 84.9 | 1806 | 388.2 | Present invention |
| | 1 | 0.77 | Equiaxed nanocrystals | 98.7 | 0.45 | 0.2 | 94.6 | 1786 | 384.6 | Present invention |
| | 10 | 0.80 | Equiaxed nanocrystals | 98.6 | 0.38 | 0.5 | 92.8 | 1795 | 385.3 | Present invention |
| 800 | 0.001 | 0.80 | Coarsened equiaxed crystals | 29.3 | 2.30 | 2.5 | 71.4 | 1400 | 366.6 | |

TABLE 1-continued

| Ti—6Al—4V alloy having a starting structure of α' martensite before working | | | | | | | | | | |
|---|---|---|---|---|---|---|---|---|---|---|
| Temperature (° C.) | Strain rate (/sec) | Strain | Structure | Area ratio of crystal grains having an average grain size of less than 1000 nm (%) | Average grain size (μm) | Area ratio of β phase (%) | Area ratio of 0 to not more than 3° of angle difference in crystal orientation in GOS map (%) | 0.2% yield strength (MPa) | Hardness (HV0.1) | Notes |
| | 0.01 | 0.83 | Equiaxed nanocrystals | 93.4 | 0.62 | 0.7 | 91.8 | 1539 | 371.1 | Present invention |
| | 0.1 | 0.80 | Equiaxed nanocrystals | 88.6 | 0.51 | 0.5 | 80.9 | 1678 | 384.2 | Present invention |
| | 1 | 0.77 | Equiaxed nanocrystals | 92.0 | 0.58 | 0.6 | 88.7 | 1674 | 385.3 | Present invention |
| | 10 | 0.81 | Equiaxed nanocrystals | 95.9 | 0.50 | 0.8 | 94.3 | 1689 | 384.7 | Present invention |
| 900 | 0.001 | 0.80 | Coarsened equiaxed crystals | 7.4 | 3.52 | 0.5 | 64.8 | 1149 | 344.8 | |
| | 0.01 | 0.85 | Coarsened α crystals and fine equiaxed crystals | 78.0 | 3.43 | 0.2 | 42.3 | 1393 | 357.2 | |
| | 0.1 | 0.77 | Equiaxed nanocrystals | 87.8 | 0.68 | 1.0 | 89.6 | 1501 | 374.5 | Present invention |
| | 1 | 0.75 | Coarsened α crystals and equiaxed nanocrystals | 81.2 | 0.74 | 0.7 | 82.5 | 1480 | 371.1 | Present invention |
| | 10 | 0.81 | Equiaxed nanocrystals | 81.3 | 0.95 | 0.7 | 94.3 | 1415 | 360.2 | Present invention |
| 1000 | 0.001 | 0.81 | Coarsened acicular structure | 7.5 | 7.89 | 1.0 | 76.6 | 1158 | 345.9 | |
| | 0.01 | 0.85 | Coarsened acicular structure | 2.5 | 16.77 | 0.3 | 59.8 | 1123 | 358.0 | |
| | 0.1 | 0.85 | Coarsened acicular structure | 5.5 | 7.65 | 0.2 | 89.4 | 1209 | 355.8 | |
| | 1 | 0.88 | Coarsened acicular structure | 3.5 | 13.68 | 0.0 | 68.2 | 1147 | 349.6 | |
| | 10 | 0.81 | Coarsened acicular structure | 4.4 | 12.99 | 0.3 | 64.7 | 1149 | 351.7 | |

Results of analyzing the backscattered diffraction patterns and results of measuring the mechanical characteristics of the samples are shown in Table 2. The samples did not have a starting structure satisfying the requirements of the present invention and were worked at conditions which satisfied the requirements of the present invention or which did not. When the starting structure was equiaxed crystals, almost the entire area was transformed to coarsened α crystals and fine crystals and had a structure that was not uniform. Moreover, the area ratio of the β phase was high, whereby the area of interfaces between the α phase and the β phase was large.

TABLE 2

| Ti—6Al—4V alloy having a starting structure of α + β mixed crystals before working | | | | | | | | | |
|---|---|---|---|---|---|---|---|---|---|
| Temperature (° C.) | Strain rate (/sec) | Strain | Structure | Area ratio of crystal grains having an average grain size of less than 1000 nm (%) | Average grain size (μm) | Area ratio of β phase (%) | Area ratio of 0 to not more than 3° of angle difference in crystal orientation in GOS map (%) | 0.2% yield strength (MPa) | Hardness (HV0.1) |
| 700 | 0.001 | 0.80 | Coarsened α crystals and fine crystals | 44.0 | 1.15 | 5.4 | 74.4 | 1435 | 371.3 |
| | 0.01 | 0.81 | Coarsened α crystals and fine crystals | 77.7 | 0.75 | 5.1 | 72.0 | 1490 | 380.7 |
| | 0.1 | 0.74 | Coarsened α crystals and fine crystals | 44.9 | 0.97 | 5.5 | 48.9 | 1556 | 373.8 |
| | 1 | 0.72 | Coarsened α crystals and fine crystals | 67.2 | 1.00 | 4.7 | 56.3 | 1426 | 368.0 |
| | 10 | 0.76 | Coarsened α crystals and fine crystals | 65.4 | 0.96 | 7.0 | 58.8 | 1460 | 368.6 |
| 800 | 0.001 | 0.80 | Coarsened equiaxed crystals | 17.5 | 1.99 | 6.8 | 70.2 | 1301 | 367.9 |
| | 0.01 | 0.83 | Coarsened a crystals and fine crystals | 50.4 | 1.19 | 4.3 | 74.4 | 1456 | 375.1 |
| | 0.1 | 0.79 | Coarsened α crystals and fine crystals | 75.2 | 0.81 | 13.2 | 65.9 | 1428 | 374.9 |
| | 1 | 0.76 | Coarsened α crystals and fine crystals | 69.1 | 1.06 | 7.6 | 62.3 | 1419 | 360.6 |

TABLE 2-continued

Ti—6Al—4V alloy having a starting structure of α + β mixed crystals before working

| Temperature (° C.) | Strain rate (/sec) | Strain | Structure | Area ratio of crystal grains having an average grain size of less than 1000 nm (%) | Average grain size (μm) | Area ratio of β phase (%) | Area ratio of 0 to not more than 3° of angle difference in crystal orientation in GOS map (%) | 0.2% yield strength (MPa) | Hardness (HV0.1) |
|---|---|---|---|---|---|---|---|---|---|
| | 10 | 0.78 | Coarsened α crystals and fine crystals | 62.2 | 1.01 | 7.4 | 61.1 | 1243 | 363.2 |
| 900 | 0.001 | 0.81 | Coarsened equiaxed crystals | 7.6 | 2.97 | 0.1 | 86.8 | 1133 | 326.3 |
| | 0.01 | 0.85 | Coarsened equiaxed crystals | 16.7 | 1.72 | 0.6 | 83.7 | 1285 | 346.5 |
| | 0.1 | 0.80 | Coarsened α crystals and fine crystals | 51.2 | 1.19 | 5.8 | 61.7 | 1256 | 370.5 |
| | 1 | 0.72 | Coarsened α crystals and fine crystals | 20.3 | 2.05 | 4.4 | 51.9 | 1180 | 359.9 |
| | 10 | 0.79 | Coarsened α crystals and fine crystals | 58.8 | 1.06 | 1.0 | 79.7 | 1261 | 359.5 |
| 1000 | 0.001 | 0.82 | Coarsened acicular structure | 13.9 | 5.50 | 0.3 | 78.5 | 1104 | 345.1 |
| | 0.01 | 0.85 | Coarsened acicular structure | 4.7 | 10.96 | 1.8 | 39.9 | 1273 | 339.2 |
| | 0.1 | 0.83 | Coarsened acicular structure | 8.0 | 4.79 | 0.2 | 93.1 | 1342 | 351.1 |
| | 1 | 0.80 | Coarsened acicular structure | 30.5 | 2.59 | 0.6 | 89.4 | 1364 | 358.8 |
| | 10 | 0.83 | Coarsened acicular structure | 9.0 | 3.30 | 0.1 | 93.8 | 1344 | 351.3 |

Figure 11:
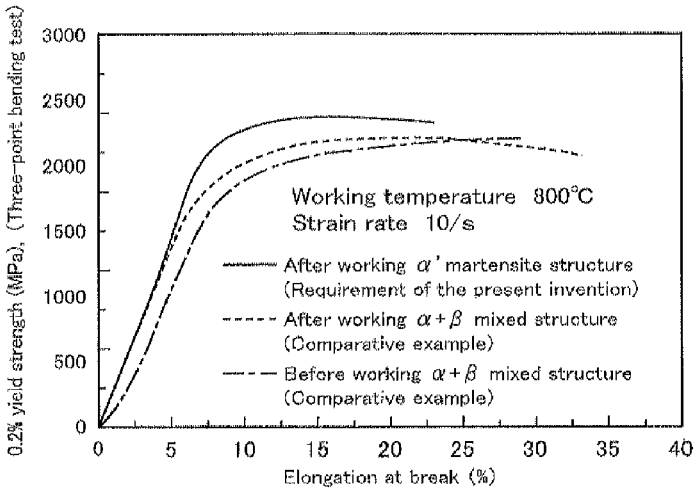
FIG. 11 is a graph showing a relationship between elongation at break and 0.2% yield strength, which is a result of a three-point bending test performed to materials of the present invention and of comparative examples.

FIG. 11 shows the results of a three-point bending test performed on a material of the present invention (starting structure was α' martensite) and materials of comparative examples (starting structure was α+β mixed crystals). These materials were worked at a working temperature of 800° C. at a strain rate of 10/second so as to have a strain of around 0.8. The example of the present invention had higher 0.2% yield strength and higher maximum bending stress in the three-point bending test. In addition, compared with 1 to 3% of an elongation at break in a tensile test of a steel material containing nanocrystals, in the example of the present invention, the elongation at break was not less than 20% in the three-point bending test and was superior. Therefore, the examples of the present invention had sufficient workability for products, and the toughness (strength×ductility) was improved to a preferable level for practical use.

Figure 2:
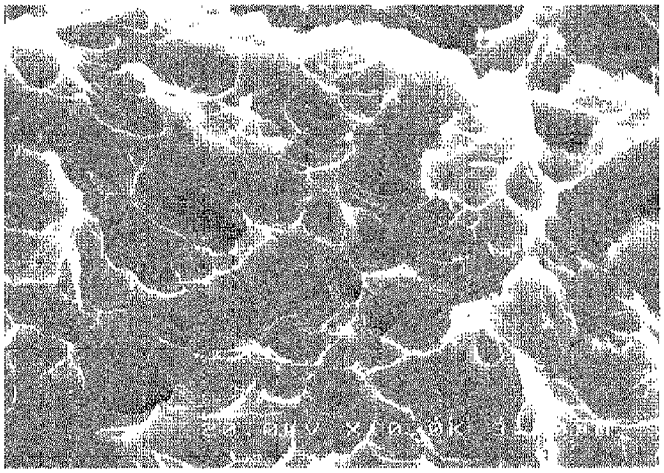
FIG. 2 shows a fracture surface of a titanium alloy with a general composition of Ti-6Al-4V type of a practical example of the present invention. This titanium alloy had a starting structure of α' martensite, and was worked at a working temperature of 800° C. at a strain rate of 10/second and was then subjected to a three-point bending test.

FIG. 2 shows a photograph of a fracture surface at a center portion of the example of the present invention after the above three-point bending test. The example had a starting structure of α' martensite phase and was worked at a working temperature of 800° C. at a strain rate of 10/second so as to have a strain of around 0.8. Since this material contained equiaxed nanocrystals that were uniformly distributed, a uniform and fine dimple pattern was obtained. This indicates that the material had high toughness and was expected to have high fatigue strength.

Figure 3:
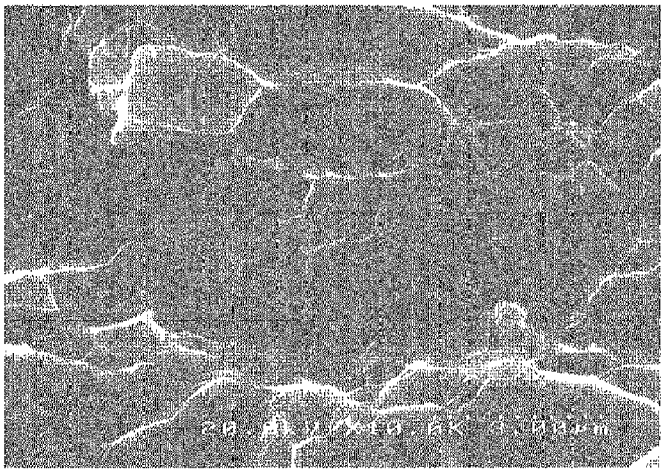
FIG. 3 shows a fracture surface of a titanium alloy with a general composition of Ti-6Al-4V type of a comparative example. This titanium alloy had a starting structure of α+β mixed crystals, and was worked at a working temperature of 800° C. at a strain rate of 10/second and was then subjected to a three-point bending test.

FIG. 3 shows a photograph of a fracture surface at a center portion of the comparative example after the three-point bending test. The comparative example had a starting structure of α+β mixed crystals and was worked at a working temperature of 800° C. at a strain rate of 10/second so as to have a strain of around 0.8. In the comparative example, some areas were dynamically recrystallized and were refined, whereby they exhibited a dimple pattern. However, the comparative example had an area containing a coarsened α phase, and this area showed a cleavage pattern. Accordingly, the toughness and the fatigue strength of the comparative example were not improved.

The invention claimed is:

1. A titanium alloy having a composition that is classified as a titanium alloy of a near α titanium or an α+β titanium consisting of 4 to 9 mass % of Al, 2 to 10 mass % of V, and the balance of Ti and inevitable impurities, the titanium alloy consisting of a uniform fine structure in which equiaxed crystals with an average grain size of less than 1000 nm are uniformly dispersed, wherein the equiaxed crystals have a β phase at more than 0% and not more than 1.0% by area ratio, which is measured by an Electron BackScattered Diffraction (EBSD) method using a phase map.

2. The titanium alloy according to claim 1, wherein the titanium alloy has a structure deformed by working, and the uniform fine structure is not less than 80% by area ratio in a freely chosen cross section of the deformed structure.

3. The titanium alloy according to claim 1, wherein the equiaxed crystals include crystal grains having less than 3° of an angle difference in crystal orientation within the crystal grain, which is measured by an Electron BackScattered Diffraction (EBSD) method using a GOS map, and an area ratio of the crystal grains is not less than 80%.

4. The titanium alloy according to claim 1, wherein the average grain size is not more than 600 nm.

5. The titanium alloy according to claim 1, wherein the titanium alloy has not less than 360 HV of hardness and not less than 1400 MPa of 0.2% bending yield strength.

6. A production method for the titanium alloy according to claim 1, comprising:

preparing a titanium alloy consisting of 4 to 9 mass % of Al, 2 to 10 mass % of V, and the balance of Ti and inevitable impurities;

working the titanium alloy containing an α' martensite phase so as to cause dynamic recrystallization.

7. The production method for the titanium alloy according to claim 6, wherein the working is performed by heating the titanium alloy at a heating rate of 50 to 800° C./second and providing strain of not less than 0.5 at a strain rate of 0.01 to 10/second in a temperature range of 700 to 800° C. or at a strain rate of 0.1 to 10/second in a temperature range of more than 800° C. and less than 1000° C., the production method further comprising cooling the titanium alloy at a cooling rate of not less than 20° C./second after the working.

8. The production method for the titanium alloy according to claim 7, wherein the titanium alloy is heated at a heating rate of 100° C./second from room temperature to a temperature that is lower than the working temperature by 100° C. and is then heated at a heating rate of 50° C./second.

9. The production method for the titanium alloy according to claim 7, wherein the titanium alloy is worked at a working temperature of 700 to 800° C. at a strain rate of 0.01 to 10/second so as to have a strain of not less than 0.8.

* * * * *